United States Patent [19]

Le Guen et al.

[11] Patent Number: 4,651,336

[45] Date of Patent: Mar. 17, 1987

[54] ROTATING-ANODE X-RAY TUBE

[75] Inventors: Jacques Le Guen, Paris; André Plessis, Clamart, both of France

[73] Assignee: Thomson-CSF, Paris, France

[21] Appl. No.: 604,815

[22] Filed: Apr. 27, 1984

[30] Foreign Application Priority Data

May 6, 1983 [FR] France ..... 83 07610

[51] Int. Cl.[4] ..... H01J 35/06; H01J 35/10

[52] U.S. Cl. ..... 378/125; 378/132; 378/134

[58] Field of Search ..... 378/125, 127, 132, 144, 378/134, 121, 119; 313/337

[56] References Cited

U.S. PATENT DOCUMENTS

| | | | |
|---|---|---|---|
| 3,878,395 | 4/1975 | Seifert et al. | 378/132 |
| 4,414,681 | 11/1983 | Seifert | 378/144 |
| 4,417,171 | 11/1983 | Schmitmann | 378/144 |

*Primary Examiner*—Craig E. Church
*Assistant Examiner*—Charles Wieland
*Attorney, Agent, or Firm*—Roland Plottel

[57] ABSTRACT

In an X-ray tube comprising a rotating anode mounted on magnetic bearings, the flow of anode current within the tube takes place without any contact by means of a stationarily fixed hollow anode in which is placed a cathode coupled rotationally to the rotating anode. The hollow anode is associated with heating means and the cathode is heated by thermal radiation within the hollow anode.

8 Claims, 4 Drawing Figures

-HT
+HT
HT'
1
2
3
4
5
6
7
8
9
10
11
12
13
14
15
16
17
18
19
20
21
22
23
24
25
29
30
31
32
35
40

ROTATING-ANODE X-RAY TUBE

BACKGROUND OF THE INVENTION

1. Field of the Invention

The invention relates to an x-ray tube of the rotating-anode type in which rotation of the anode takes place by means of magnetic bearings.

2. Description of the Prior Art

High-power x-ray tubes usually make use of rotating anodes which are still very commonly designed for rotation by means of mechanical bearings. By reason of the high speed of rotation which can attain 20,000 revolutions per minute, these mechanical bearings are subject to rapid wear and are frequently the cause of withdrawal of x-ray tubes from service.

One significant improvement consists in mounting the rotating anode with magnetic bearings. These bearings usually comprise electromagnets which are mounted in opposition in pairs and a rotor which is rigidly fixed to the rotating anode in order to drive this latter in rotation, the rotor being maintained in equilibrium under the influence of the magnetic fields produced by the electromagnets. Thus the rotating anode and the mechanical parts which accompany this latter in rotational motion no longer have any mechanical contact with the remainder of the x-ray tube.

However, a new problem created by this improvement lies in the fact that the anode is isolated from the remainder of the x-ray tube, not only from a mechanical standpoint but also electrically. In consequence, both the connection of the anode to the high-voltage supply of the x-ray tube and the flow of anode current have been achieved only in an imperfect manner up to the present time. The solutions proposed are often sliding-contact or ball systems which are consequently mechanical, thereby losing part of the advantage of the magnetic-bearing system, namely the total absence of mechanical friction.

Another solution which permits the flow of anode current without any mechanical contact utilizes the emission of electrons generated by thermoemissive cathodes coupled mechanically to the rotating anode, these electrons being collected by fixed anodes. One of the main difficulties in this case consists in ensuring that, when these cathodes are set in rotation, they are supplied with the necessary energy for producing a rise in the cathode temperature level which is sufficient to satisfy the laws of thermoelectronic emission.

Up to the present time, this difficulty has been circumvented by means of relatively complex and costly solutions which consist for example in utilizing induction phenomena for transferring to these cathodes the energy which is necessary in order to heat them. One solution of this type is described in a French patent Application published under No. 2,494,496.

This French patent Application describes the arrangement of a rotating-anode x-ray tube provided with magnetic bearings and with means for passing the anode current without any contact. In this French patent Application, a rotating anode 3 rigidly fixed to a rotor 5 is mounted on magnetic bearings 9, 10. In order to discharge the anode current, the rear end of the rotor 5 is provided with two cathodes 13, 14 which rotate about a shaft 12 on which is mounted an anode 20. The cathodes 13, 14 are provided with windings 15, 16 which are adapted to cooperate with a plurality of excitation coils 17 during the movement of rotation of the anode 3.

These excitation coils 17 are disposed at intervals around the periphery of the x-ray tube and induce the heating voltage for the cathodes 13, 14 within the rotating windings 15, 16.

The practical application of this solution is complicated and carries a heavy cost penalty. Furthermore, problems of reliability may arise from the high temperatures to which the rotating windings 15, 16 are exposed. In point of fact, these windings 15, 16 must behave as electric insulators which are capable of withstanding these temperatures and are not liable to have a degassing effect. This requirement presents a technological problem which has not yet been satisfactorily solved.

SUMMARY OF THE INVENTION

In the present invention, cathode heating for passing an anode current is obtained by adopting a combination of means which are much more simple and are not attended by the disadvantages mentioned in the foregoing.

This invention relates to a rotating-anode x-ray tube which is mounted on magnetic bearings and makes it possible to pass the anode current without any contact. In the x-ray tube contemplated by the invention, this result is obtained with greater ease and at lower cost than in the prior art, especially by making use of a thermoemissive cathode and a novel arrangement whereby the cathode is heated by thermal radiation.

In accordance with the invention, a rotating-anode x-ray tube comprising a rotating anode mounted on magnetic bearings and at least one device for passing the anode current of the x-ray tube is distinguished by the fact that said device comprises a stationarily fixed hollow anode within which a cathode is rotationally coupled to the rotating anode. The hollow anode is associated with heating means and connected to the positive pole of the high-voltage supply whilst the cathode is electrically connected to the rotating anode in such a manner as to pass the anode current.

BRIEF DESCRIPTION OF THE DRAWINGS

Other features of the invention will be more apparent upon consideration of the following description and accompanying drawings, wherein.

DETAILED DESCRIPTION OF THE INVENTION

Figure 1:
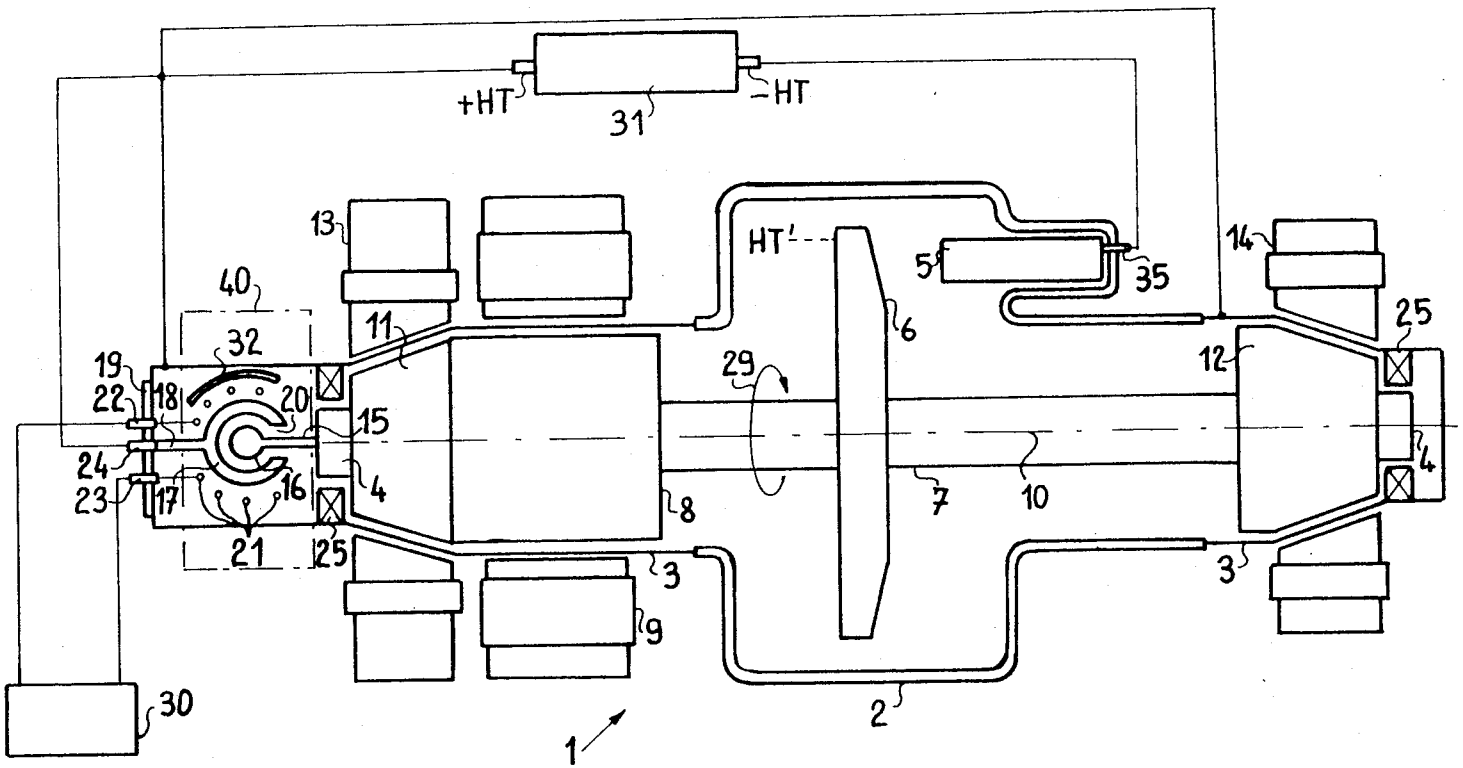
FIG. 1 is a schematic diagram showing an x-ray tube in accordance with the invention.

The x-ray tube 1 in accordance with the invention as illustrated in FIG. 1 has a vacuum-tight envelope 2-3 constituted in the non-limitative example herein described by a central isolating section 2 and by end sections 3 formed by metal sleeves of small thickness. A main cathode 5 carried by the central isolating section 2 has the intended function of delivering an electron beam (not shown in the drawings) which impinges on a rotating anode 6 and produces the x-radiation.

The rotating anode 6 is carried by a metal shaft 7 which is rigidly fixed to a rotor 8. In conjunction with a stator 9 located outside the envelope 2-3, said rotor 8 forms a motor which drives the anode 6 in rotation about a longitudinal axis 10. The shaft 7 is also rigidly fixed at its ends 4 to rotating portions 11, 12 which are conical in the non-limitative example herein described and constitute the suspended portions of magnetic bearings 11-13, 12-14. Active portions 13, 14 of said magnetic bearings are located outside the envelope 2-3. Within said envelope are disposed guard bearings 25 which are located opposite to the ends 4 of the shaft 7 and with which said bearings 25 are in contact only in the event of failure of the magnetic suspension.

As shown in chain-dotted outline, the tube 1 also comprises a device 40 which is located within the envelope 2-3 and is intended to pass the anode current of the x-ray tube 1 during operation.

Said device 40 comprises a metal shaft 15 which forms an extension of the shaft 7 along the longitudinal axis 10 at the end corresponding to the rotor 8. Said shaft 15 is adapted to carry a cathode 16 which is of spherical shape in the non-limitative example under consideration and is centered on the longitudinal axis 10. Said cathode is electrically connected to the rotating anode 6 by means of the metal shaft 15 and the shaft 7 and is brought to the same potential as the anode during operation.

A hollow anode 17 which also has a spherical shape in the non-limitative example herein described is maintained in a fixed position and centered around the cathode 16 by means of a metal support 18 rigidly fixed to an insulating support 19. The hollow anode 17 has an opening 20 through which the metal shaft 15 is intended to pass, thus permitting the movement of the cathode 16 which is rotationally coupled to the anode 6 so as to rotate within the hollow anode 17. As in the case of the rotating anode 6, said cathode rotates about the longitudinal axis 10 in the direction of the arrow 29.

There is placed around the hollow anode 17 a heating filament 21 supported in conventional manner by means (not shown) and connected to two vacuum-tight lead-through bushings 22, 23 provided in the insulating support 19 which is also vacuum-tight. Said insulating support is provided with a third lead-through bushing 24 which is also electrically connected to the metal support 18 of the hollow anode 17.

The heating filament 21 formed of tungsten in the non-limitative example considered is intended to increase the temperature of the hollow anode 17. To this end, the filament 21 is heated by Joule effect and the two lead-though bushings 22, 23 to which it is connected within the x-ray tube 1 are connected to a conventional voltage source such as a transformer 30, for example.

The high voltage required for the operation of the x-ray tube 1 is delivered in known manner by a high-voltage generator 31. A positive high-voltage output +HT is connected to the end sections 3 as well as to the third lead-through bushing 24 in order to be applied to the hollow anode 17. A negative output −HT of the generator 31 is connected in conventional manner to the main cathode 5 via a fourth lead-through bushing 35, said main cathode being also provided with heating connections in known manner (not shown).

During operation, the heating filament 21 heats the hollow anode 17 which constitutes a practically closed chamber in which the cathode 16 is heated in its turn as in a furnace by the thermal radiation of the hollow anode 17. In order to limit heat losses, the device 40 can comprise (as in the non-limitative example described) a thermal reflector 32 which is shown only partially in the figure and which surrounds the heating filament 21.

The cathode 16 which is connected electrically to the rotating anode 6 accordingly generates electrons which are collected by the hollow anode 17, said anode being connected to the positive pole +HT of the high-voltage generator. The intensity of the electron current thus generated is the same as that of the electron beam produced by the main cathode 5 and directed to the rotating anode 6. The anode current of the tube 1 is thus passed with a small voltage difference between the positive polarity +HT of the high-voltage supply and the value +HT′ established at the level of the rotating anode 6. By means of this arrangement, the path between hollow anode and cathode 17, 16 can have a low impedance which would make it possible to pass an electron current at a low voltage and at an intensity which is considerably higher than that required under normal utilization conditions, with the result that the operation of the x-ray tube 1 is not liable to be disturbed under any circumstances. A further point worthy of note is that the power dissipated in the form of heat at the level of the hollow anode 17 as a result of impact of the electrons which form the anode current serves to establish favorable conditions for the electron emission of the cathode 16.

Thus the thermal energy supplied by the heating filament 21 is transferred to the cathode 16 by means of the hollow anode 17 in order to constitute the energy which is necessary for extraction of the electrons. This energy transfer can be made more efficient by suitable arrangements of the cathode and of the hollow anode 16, 17 and by making use of a second voltage source as explained with reference to FIG. 2. For the sake of enhanced clarity of FIG. 2, the representation of the x-ray tube in accordance with the invention is limited in order to provide a better illustration of the device 40.

Figure 2:
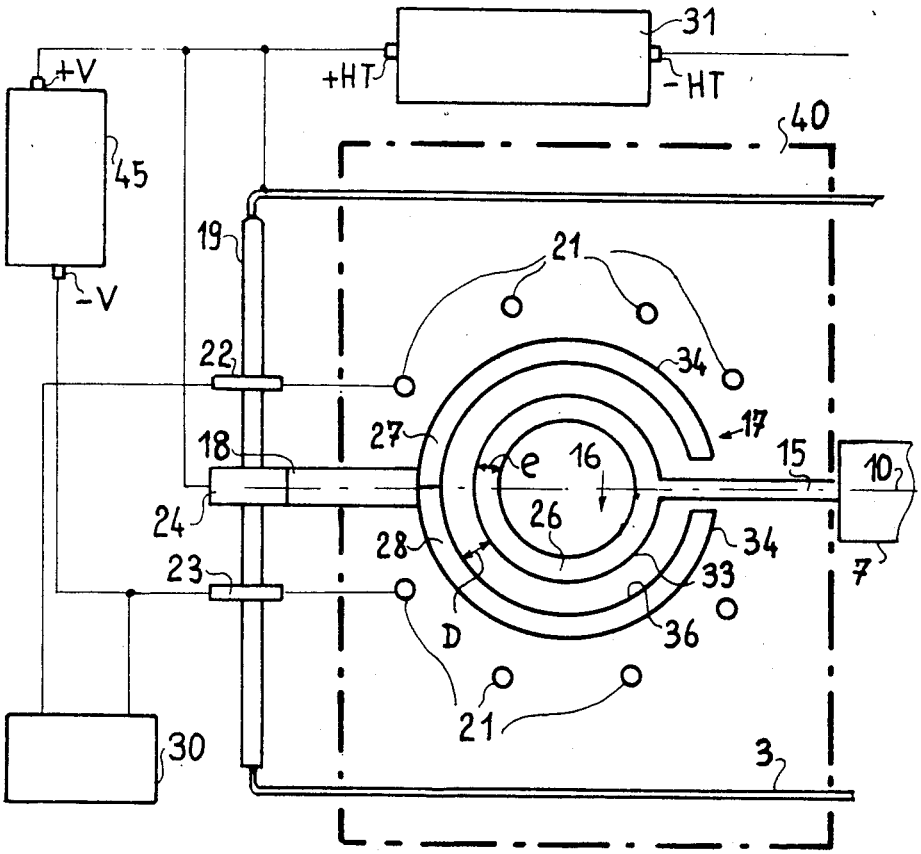
FIG. 2 shows more particularly the means forming part of the device for passing the anode current of the x-ray tube in accordance with the invention.

With a view to reducing the energy which is necessary for extraction of electrons, the cathode 16 can be of hollow construction as in the example shown in FIG. 2 in which it has the shape of a sphere. This shape can be different as will be explained in the remainder of the description. The cathode 16 comprises a wall 26 having a small thickness E and preferably formed of refractory material such as tantalum or thoriated tungsten. The external surface 33 of said wall 26 can also be provided with a coating (not shown) of lanthanum boride, for example, in order to increase the electron emissivity.

In the non-limitative example described, the hollow anode 17 is formed by two assembled half-spheres 27, 28 formed of graphite such as pyrolytic graphite, for example, or alternatively of refractory material such as tungsten or molybdenum.

In order to achieve even greater efficiency of heating of the hollow anode 17 and consequently the efficiency of heating of the cathode 16, the x-ray tube in accordance with the invention comprises a supply source consisting of a low-voltage direct-current generator 45.

A positive output V+ of said low-voltage generator 45 is connected to the hollow anode 17 and also to the positive pole +HT of the high-voltage generator. A negative output −V is connected to one end of the heating filament 21, for example to the lead-through bushing 23. The direct-current voltage delivered by said low-voltage generator 45 determines a potential difference between the heating filament 21 and the hollow anode 17. As a result of this potential difference, the hollow anode 17 which is positive with respect to the heating filament 21 is subjected to a bombardment by electrons emitted by said filament. This electron bombardment of the hollow anode 17 gives rise in this latter to a high temperature which determines its thermal radiation in the direction of the cathode 16.

The mode of heating of the hollow anode 17 just mentioned can be employed either alone or in conjunction with the mode of heating described earlier. The thermal screen 32 (not shown in FIG. 2) can be retained in this alternative method.

In this variant and in the case previously mentioned in which the hollow anode 17 is of graphite, its outer surface 34 is preferentially coated with a highly reflective metallic deposit of the type known as a mirror coating, for example. When the hollow anode 17 is of refractory material, its external surface 34 can also be highly reflective (mirror coating) whilst its internal surface 36 is coated with material (not shown) having high thermal radiation power.

This description constitutes a non-limitative example of an x-ray tube in accordance with the invention in which the anode current of the tube 1 can be passed without entailing the need for any contact between the stationary portions and rotating portions of the tube. This result is achieved by virtue of a novel arrangement of the x-ray tube in which a device 40 comprises in particular an electron-emitting cathode 16 which receives the electron extraction energy by means of the radiation of a hollow anode 17 which is intended to collect these electrons. The shape of said cathode 16 and of said hollow anode can be different from that shown in FIGS. 1 and 2. The essential condition is to ensure that the cathode 16 which is rigidly fixed to the rotating anode 6 is located within a heated enclosure constituting a hollow anode 17. Nevertheless, the shapes of the hollow anode 17 and of the cathode 16 are preferably adapted to ensure that their oppositely-facing surfaces 36, 33 are located at a distance D which is as constant as possible.

Figure 3:
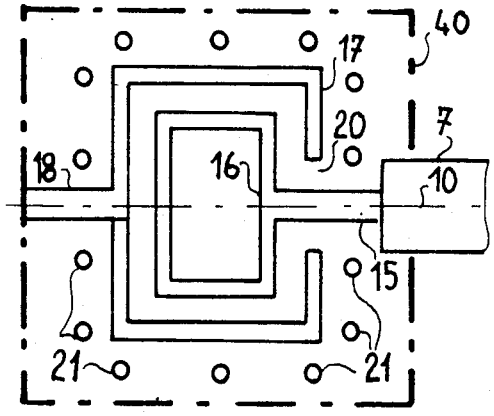
FIG. 3 shows an alternative embodiment of the device for passing the anode current.

Thus it follows that, by way of example, the hollow anode 17 and the cathode 16 can also have a conical shape or a cylindrical shape as shown in FIG. 3.

This arrangement of the hollow anode 17 and of the cathode 16 also makes it possible to employ heating means which are different from those consisting of the heating filament 21 and the low-voltage generator 45. Heating of the cathode 16 is produced by the thermal radiation of the hollow anode 17. Another point worthy of mention is that the combination of means of the device 40 can also be located at either of the ends 3 of the envelope 2-3 or at both ends.

Figure 4:
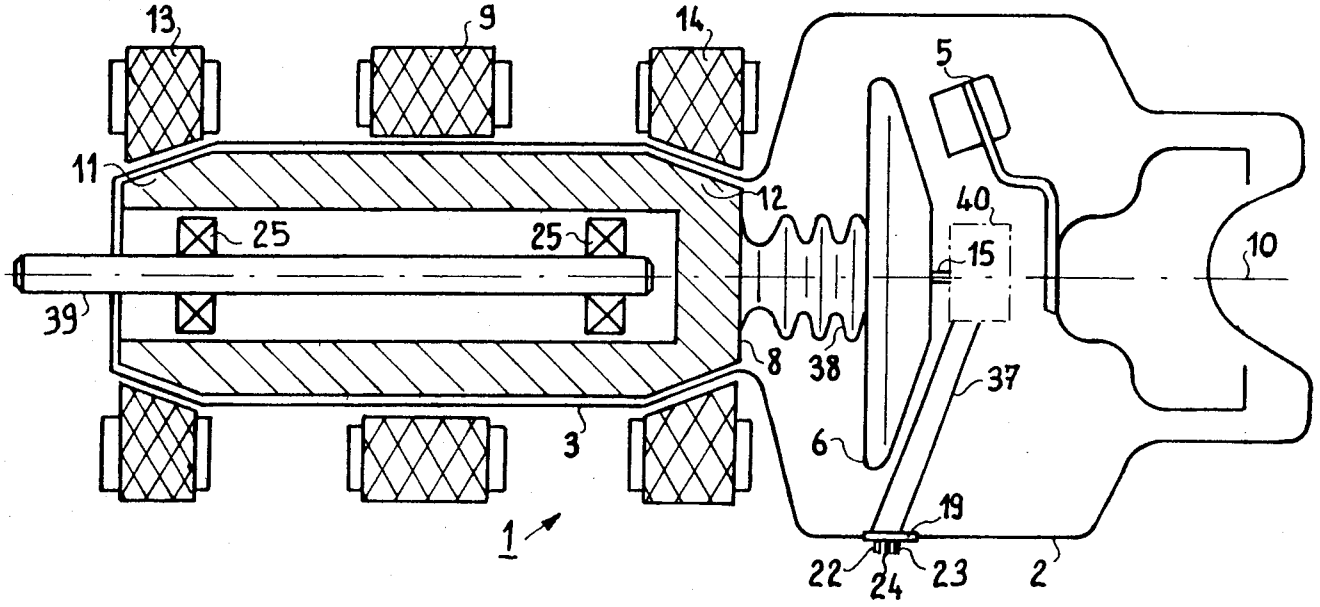
FIG. 4 is a schematic diagram showing an alternative embodiment of the x-ray tube in accordance with the invention.

It should finally be noted that the device 40 already described in detail can also be adapted to different positions as shown in the non-limitative example of FIG. 4 in which said device is represented by a rectangle in chain-dotted outline.

FIG. 4 shows an x-ray tube 1 in accordance with the invention in which the magnetic bearings 11-13, 12-14 are located on one and the same side of the rotating anode 6.

In this embodiment of the x-ray tube 1, its envelope is constituted by a metallic end-section 3 and an isolating section 2 which contains the rotating anode 6 and the main cathode 5. The metallic end-section 3 as well as the magnetic bearings 11-13, 12-14 and the rotor 8 are brought to ground potential by conventional means (not shown in the drawings). The guard bearings 25 are placed around a fixed shaft 39 which is disposed within the rotor 8 along the longitudinal axis 10.

The rotor 8 drives the rotating anode 6 in rotation about the longitudinal axis 10 by means of an insulating shaft 38. This shaft is formed of refractory material having a high electrical insulating capacity such as, for example, alumina or ceramic material as in the example described.

In this version of the x-ray tube 1 in accordance with the invention, the device 40 which serves to pass the anode current is located in the immediate proximity of the rotating anode 6 to which it is coupled both mechanically and electrically by means of the metal shaft 15. The cathode 16 (not shown in FIG. 4) is coupled rotationally to the rotating anode 6 as explained earlier.

The internal electrical connections (not shown) which are necessary for the device 40 are passed out of the x-ray tube 1 through a sleeve 37 formed of refractory material having a very low coefficient of expansion such as alumina or ceramic material, for example. These internal connections terminate at the lead-through bushings 22, 23, 24 of the insulating support 19.

In this arrangement, the operation of the device 40 remains the same as in the arrangement explained earlier and the same applies to the external electrical connections (not shown in FIG. 4). In this last-mentioned embodiment, however, there is one exception, namely the fact that the end section 3 is at ground potential and is therefore no longer connected to the positive output terminal +HT of the high-voltage generator 31.

An x-ray tube 1 in accordance with the invention is applicable to all fields of radiology in which it provides a simple, reliable and low-cost solution by means of the device 40 which serves to pass the anode current without any contact.

What is claimed is:

1. A rotating-anode x-ray tube comprising a rotating anode mounted on magnetic bearings and at least one device for passing the anode current of the X-ray tube between a positive pole of a high-voltage supply and the rotating anode, wherein said device comprises a stationarily fixed hollow anode within which a cathode is rotationally mounted and mechanically fixidly coupled to said rotating anode, the hollow anode being surrounded by a heating filament for heating said anode, said hollow anode being adapted to be connected to a positive pole of the high-voltage supply, and the chathode being electrically connected to the rotating anode so as to pass the anode current.

2. An x-ray tube according to claim 1, wherein the heating filament is surrounded by a thermal reflector.

3. An x-ray tube according to claim 1, wherein the heating means further comprise a low-voltage generator which cooperates with the heating filament and the hollow anode in order to produce between said filament and said anode a potential difference which permits electron bombardment of said hollow anode.

4. An x-ray tube according to claim 1, wherein the hollow anode constitutes a practically closed chamber which performs the function of a furnace for heating the cathode.

5. An x-ray tube according to claim 1, wherein the cathode is of hollow construction.

6. An x-ray tube according to claim 1, wherein the hollow anode and the cathode have shapes so designed as to ensure that the internal and external surfaces respectively of said anode and cathode are located at a constant distance from each other.

7. An x-ray tube according to claim 1, wherein the hollow anode and the cathode have the shape of a sphere.

8. An x-ray tube according to claim 1, wherein the hollow anode and the cathode have a cylindrical shape.

* * * * *